US007486238B2

(12) United States Patent
Ogawa et al.

(10) Patent No.: US 7,486,238 B2
(45) Date of Patent: Feb. 3, 2009

(54) CIRCULAR POLARIZED WAVE ANTENNA AND METHOD FOR DESIGNING SAME

(75) Inventors: Tomoyuki Ogawa, Hitachi (JP); Ken Takei, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 59 days.

(21) Appl. No.: 11/806,664

(22) Filed: Jun. 1, 2007

(65) Prior Publication Data

US 2008/0012772 A1 Jan. 17, 2008

(30) Foreign Application Priority Data

Jul. 11, 2006 (JP) ..... 2006-190135

(51) Int. Cl.
*H01Q 1/38* (2006.01)

(52) U.S. Cl. ..... 343/700 MS; 343/853

(58) Field of Classification Search ..... 343/700 MS, 343/702, 853

See application file for complete search history.

(56) References Cited

U.S. PATENT DOCUMENTS 5,063,391 A * 11/1991 Jaggard et al. ..... 343/703
2006/0181467 A1* 8/2006 Takei ..... 343/702
2006/0267845 A1* 11/2006 Takei et al. ..... 343/700 MS
2007/0046542 A1* 3/2007 Andrenko et al. ..... 343/700 MS
2008/0158086 A1* 7/2008 Yamagajo et al. ..... 343/795

FOREIGN PATENT DOCUMENTS

JP 5-152830 6/1993
JP 8-51312 2/1996

OTHER PUBLICATIONS

"Small size plane antenna" by Misao Haneishi et al, 1996, Institute of Electronics, Information and Communication Engineers, pp. 142-164.
"New Antenna Technology" by Hiroyuki Arai, 2001 Sogo Denshi Shuppan, p. 9.

* cited by examiner

*Primary Examiner*—Tho G Phan
(74) *Attorney, Agent, or Firm*—McGinn IP Law Group, PLLC

(57) ABSTRACT

A group of metallic conductors 1 are prepared and a power feed point 2 is formed at one of the metallic conductors to provide a circular polarized wave antenna. The circular polarized wave antenna is designed such that an absolute value of a sum of projections of an electric current induced on the metallic conductors in x-axis and an absolute value of a sum of projection of the electric current in y-axis that is spatially orthogonal to the x-axis are approximately equal to each other, and an absolute value of a difference between an argument of the sum of the projections in the x-axis and an argument of the sum of the projection in the y-axis is approximately 90°.

10 Claims, 9 Drawing Sheets

CIRCULAR POLARIZED WAVE ANTENNA AND METHOD FOR DESIGNING SAME

The present application is based on Japanese Patent Application No. 2006-190135 filed on Jul. 11, 2007, the entire contents of which are incorporated herein by reference.

BACKGROUND OF THE INVENTION

1. Field of the Invention

The present invention relates to a circular polarized wave antenna and a method for designing the same, which is used for a radio communication system such as satellite communication.

2. Description of the Related Art

A position detecting system such as so-called "GPS" (Global Positioning System), satellite radio broadcasting, and the like are radio communication systems using circular polarized wave. A transceiver (transmitting and receiving apparatus) corresponding to such a radio communication is generally provided with a circular polarized antenna.

As a representative example of the circular polarized wave antenna, a single feed microstrip antenna disclosed in the "Small size plane antenna" by Misao Haneishi et al, 1996, Institute of Electronics, Information and Communication Engineers, pages 142 to 164, has been known. In the single feed microstrip antenna, two modes spatially orthogonal to each other are generated by providing a degeneracy separating element, to transmit and/or receive the circular polarized wave. Concerning electrical dimensions of the single feed microstrip antenna as shown in this document, a length of one side is about a ½ wavelength at a frequency to be used. For example, the length of the single feed microstrip antenna is about 95 mm at a frequency of 1575 MHz which is used for the GPS. Since such dimensions are too large for an antenna for a mobile transmitting and receiving apparatus, the size of the single feed microstrip antenna is reduced by using a high dielectric material such as ceramic, and broadly put to practical use.

As explained above, a small-sized circular polarized wave antenna is required in the mobile transmitting and receiving apparatus. So as to solve this problem, various small-sized circular polarized wave antennas have been studied. For example, Japanese Patent Laid-Open No. 05-152830 and Japanese Patent Laid-Open No. 08-051312 disclose techniques of forming the small-sized circular polarized wave antennas.

In a microstrip antenna disclosed by Japanese patent Laid-Open No. 05-152830, notches are provided at both terminals of a conductor along directions of two straight lines that are orthogonal to each other with an angle of ±45° with respect to two oscillation mode directions having different phases and orthogonal to each other, so that any one of the straight lines orthogonal to each other with an angle of ±45° with respect to the oscillation mode directions coincides with a deviated direction of a power feed point, thereby lowering an oscillation frequency. According to this structure, the antenna size can be reduced compared with that of the conventional antenna used at the same frequency.

In a circular polarized wave loop antenna disclosed by Japanese Patent Laid-Open No. 08-051312, a liner antenna element comprising a loop as a basic element is used for reducing the size of the antenna.

According to a conventional technique for providing a microstrip antenna disclosed by Japanese patent Laid-Open No. 05-152830, it is possible to reduce the antenna size by keeping the two modes spatially orthogonal to each other that are necessary for transmitting and receiving the circular polarized wave. However, there is a difficulty in adjusting impedance. Although the technique for adjusting reactance is disclosed, repetition of trial and error is required for adjusting resistance.

According to a conventional technique for providing a circular polarized wave loop antenna disclosed by Japanese Patent Laid-Open No. 08-051312, it is possible to transmit and receive the circular polarized wave by adjusting an aspect ratio of a rectangular loop element and a distance between the element and the ground. However, there is also a difficulty in adjusting impedance. Although there are described a technique for adjusting the impedance by loading a reactance on a part of a radiating element and a technique for adjusting an impedance by connecting a plurality of radiating elements in parallel, miniaturization of the antenna is reversely hindered as a result.

Therefore, a small-sized circular polarized wave antenna with high possibility of design and a method for designing the same have been desired.

SUMMARY OF THE INVENTION

Accordingly, it is an object of the present invention to provide a small-sized circular polarized wave antenna with high possibility of design and high performance.

It if a further object of the present invention to provide a method for designing a circular polarized wave antenna by which a small-sized circular polarize wave antenna with high possibility of design and high performance can be obtained.

According to a first feature of the invention, a circular polarized wave antenna comprises:

a group of metallic conductors; and a power feed point formed at one of the metallic conductors;

wherein an absolute value of a sum of projections of an electric current induced on the metallic conductors in a first axis and an absolute value of a sum of projection of the electric current in a second axis that is spatially orthogonal to the first axis are approximately equal to each other, and an absolute value of a difference between arguments of the sums of the projections in the first and second axes is approximately 90°.

The circular polarized wave antenna according to the first feature of the invention is a circular polarized wave antenna based on a principle that the circular polarized wave is transmitted and received by a plurality of electric currents induced on the group of the metallic conductors that is different from that of the conventional single feed microstrip antenna. Further, there are unexpected advantages in the circular polarized wave antenna according to following features of the invention.

In the circular polarized wave antenna, an outline of the group of the metallic conductors may be a rectangular shape, and comprise a first side with a first electrical length and a second side with a second electrical length.

Compared with the conventional single feed microstrip antenna that has been broadly put to practical use, in the circular polarized wave antenna according to the above feature of the invention, the outline of the metallic conductors is not required to be substantially square. Therefore, it is possible to increase the possibility of a shape of a transmitting and receiving apparatus or a receiving module provided with an antenna.

In the circular polarized wave antenna, it is preferable that the circular polarized wave antenna is adapted to transmit and receive a circuit polarized wave having a single frequency, and a sum of the first electrical length and the second electrical length is from 0.4 times to 0.65 times more than a wavelength at the frequency to be used.

According to the above feature of the invention, a ½ wavelength or ¼ wavelength oscillation path can be formed by providing a microstructure in a short shape, so that a sum of an electrical length a and an electrical length b can be from 0.4 times to 0.65 times more than a wavelength at the frequency to be used.

Compared with the conventional single feed microstrip antenna that has been commercially used, the circular polarized wave antenna according to the above feature of the invention is sufficiently small. Therefore, it is effective for miniaturizing the transmitting and receiving apparatus or the receiving module provided with an antenna.

In the circular polarized wave antenna, the circular polarized wave antenna is adapted to transmit and receive circular polarized waves having different frequencies, and a sum of the first electrical length and the second electrical length is from 0.8 times to 1.6 times more than a wavelength at each of the frequencies to be used.

According to the above feature of the invention, it is possible to transmit and receive a plurality of circular polarized wave shaving different frequencies by a single antenna. Therefore, it is effective for realizing the transmitting and receiving apparatus with high functions and for simplifying an antenna periphery part thereof.

In the circular polarized wave antenna, a first frequency and a second frequency in the different frequencies may be adjacent to each other and the circular polarized wave may be transmitted and received at all frequencies between the first and second frequencies.

According to the above feature of the invention, it is possible to transmit the circular polarized wave in a broad frequency band, and suitable for providing the transmitting and receiving apparatus with high performance.

In the circular polarized wave antenna, it is preferable that the first and second frequencies satisfy following condition:

$$f3=(f1+f2)/2, \text{ and}$$

$$f2-f1 \leqq 0.25 \times f3,$$

wherein f1 is the first frequency, f2 is the second frequency, and f3 is a center frequency between the first and second frequencies.

In the circular polarized wave antenna, a right-handed circular polarized wave may be transmitted and received at the first frequency, and a left-handed circular polarized wave may be transmitted and received at the second frequency.

According to the above feature of the invention, it is possible to transmit and receive the right-handed circular polarized wave and the left-handed circular polarized wave by using a single antenna. Therefore, it is effective for realizing the transmitting and receiving apparatus with high functions and for simplifying the antenna periphery part thereof.

In the circular polarized wave antenna, the group of the metallic conductors may comprise a group of square segments.

According to a second feature of the invention, a method for designing a circular polarized wave antenna, comprises:

a first step of providing a group of metallic conductors comprising a group of square segments;

a second step of changing a structure of the metallic conductors;

a third step of calculating an electric current induced in the group of the square segments;

a fourth step of calculating an absolute value of a sum of projections of the electric current in a first axis and an absolute value of a sum of projection of the electric current in a second axis that is spatially orthogonal to the first axis, and an absolute value of a difference between arguments of the sums of the projections in the first and second axes; and a fifth step of changing the structure of the metallic conductors, until the absolute value of the sum of the projections of the electric current in the first axis and the absolute value of the sum of projection of the electric current in the second axis is approximately equal to each other and the absolute value of the difference in the arguments is approximately 90°.

In the method for designing a circular polarized wave antenna, the first to fifth steps may be conducted for different frequencies respectively.

According to the above feature of the invention, it is possible to design the circular polarized wave antenna automatically by means of the computer. Therefore, it is possible to easily design the circular polarized wave antenna in accordance with the respective specification requirements in a short time.

According to the present invention, it is possible to realize a small-sized circular polarized wave antenna with high possibility of design and high performance and a method for designing same.

BRIEF DESCRIPTION OF THE DRAWINGS

Preferred embodiments present invention will be described in conjunction with appended drawings, wherein:

FIGS. 5A and 5B are graphs showing antenna characteristics of the circular polarized wave antenna in the first preferred embodiment according to the invention, wherein FIG. 5A is a graph showing a variation of an axial ratio (AR) at a frequency of 1.50 to 1.70 GHz, and FIG. 5B is a graph showing a variation of a voltage standing wave ratio (VSWR) at a frequency of 1.40 to 1.70 GHz;

FIGS. 10A to 10D are graphs showing antenna characteristics of the circular polarized wave antenna in the third preferred embodiment according to the invention, wherein FIG. 10A is a graph showing a variation of an axial ratio (AR) at a frequency of 1.50 to 1.70 GHz, FIG. 10B is a graph showing a variation of an axial ratio (AR) at a frequency of 2.10 to 2.50 GHz, FIG. 10C is a graph showing a variation of a voltage standing wave ratio(VSWR) at a frequency of 1.50 to 1.70

GHz, and FIG. 10D is a graph showing a variation of a voltage standing wave ratio(VSWR) at a frequency of 2.10 to 2.50 GHz;

FIGS. 12A and 12B are graphs showing antenna characteristics of the circular polarized wave antenna in the fourth preferred embodiment according to the invention, wherein FIG. 12A is a graph showing a variation of an axial ratio (AR) at a frequency of 3.5 to 4.5 GHz, and FIG. 12B is a graph showing a variation of a voltage standing wave ratio (VSWR) at a frequency of 3.5 to 4.5 GHz.

DETAILED DESCRIPTION OF THE PREFERRED EMBODIMENTS

Next, preferred embodiments according to the present invention will be explained in more detail in conjunction with appended drawings.

For transmitting and receiving a circular polarized wave, it is required that absolute values of projections in two axes spatially orthogonal to each other of an electric current induced on the metallic conductors are approximately equal to each other, and an absolute value of a difference between arguments of the projections in the two axes is approximately 90° in a plane vertical to an arriving direction of the circular polarized wave.

The radiation characteristics of the antenna can be established by calculating the radiation characteristics of respective electric currents flown in the metallic conductors and totalizing the respective calculation results, as described in "New Antenna Technology" by Hiroyuki Arai, Sogo Denshi Shuppan, 2001, page 9. However, assuming a significantly distant radiation field such as a space between the earth and a satellite, a size of the antenna is significantly small in relative, so that the antenna may be considered as a point when viewed from the satellite. In such a case, an intensity and a phase of the radiation field are determined in accordance with a sum of the respective currents flown into a group of metallic conductors constituting the antenna. Namely, the intensity of the radiation field is proportional to an intensity of the sum of the respective currents, and the phase of the radiation field is equal to a phase of the sum of the respective currents. From the above point of view, the circular polarized wave antenna in the preferred embodiment according to the invention is such constituted that absolute values of the sum of the projections in two axes spatially orthogonal to each other of electric currents induced on the metallic conductors are approximately equal to each other, and an absolute value of a difference between arguments of the sum of the projections in the two axes is approximately 90°, so as to transmit and receive the circular polarized wave.

Figure 1:
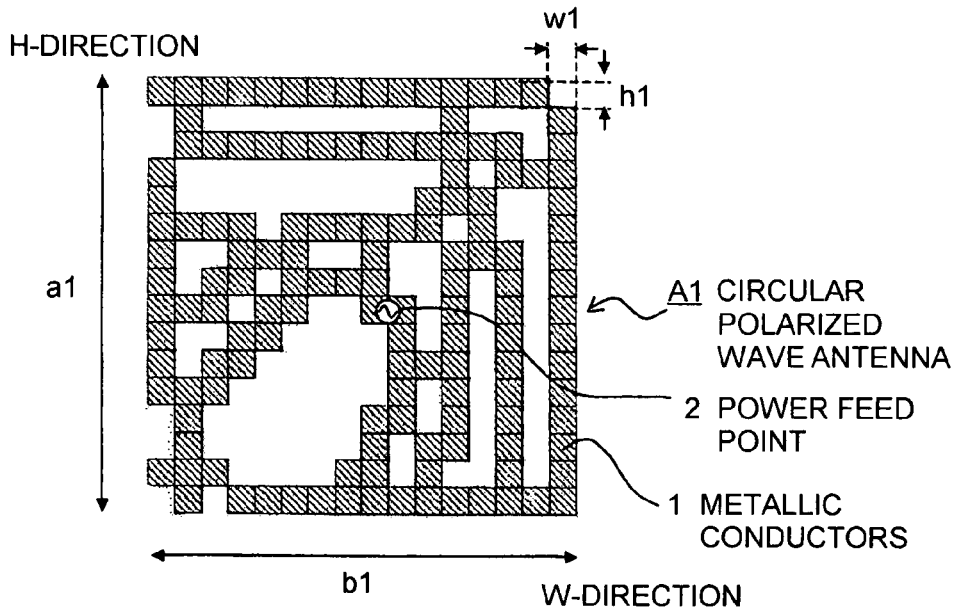
FIG. 1 is a schematic diagram showing a circular polarized wave antenna in a first preferred embodiment according to the invention.

FIG. 1 is a schematic diagram showing a circular polarized wave antenna A1 in a first preferred embodiment according to the invention.

A circular polarized wave antenna A1 comprises a group of metallic conductors 1 and a single power feed point 2, for transmitting and receiving a right-handed circular polarized wave at a frequency of 1575 MHz which is used for the GPS.

In the first preferred embodiment, a group of the metallic conductors 1 in the circular polarized antenna A1 has an outline of a rectangular (square-like) shape, for example, with an electrical length a1 of 48 mm in a H-direction and an electrical length1 b of 48 mm in a W-direction, respectively. A sum of the electrical wavelengths a1 and b1 of both sides in the H and W directions is approximately ½ wavelength at a frequency of 1575 MHz to be used. The group of the metallic conductors 1 is composed of an agglomeration of square metallic conductors each having dimensions of for example 3 mm×3 mm (a height h1 of 3 mm and a width w1 of 3 mm). The circular polarized wave antenna in the first preferred embodiment is small and thin, and suitable for mounting on a mobile transmitting and receiving apparatus.

Figure 2:
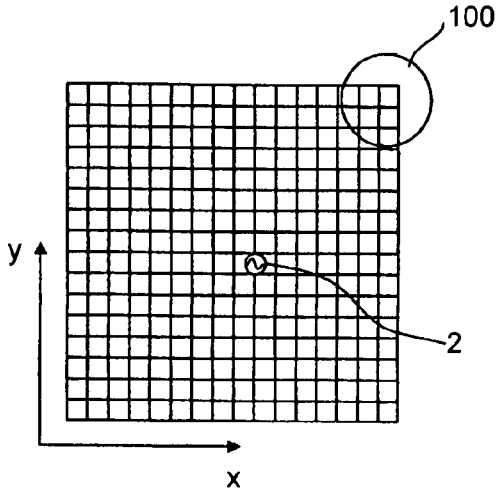
FIG. 2 is a schematic diagram for explaining a method for designing a circular polarized wave antenna in the first preferred embodiment according to the present invention.
Figure 3:
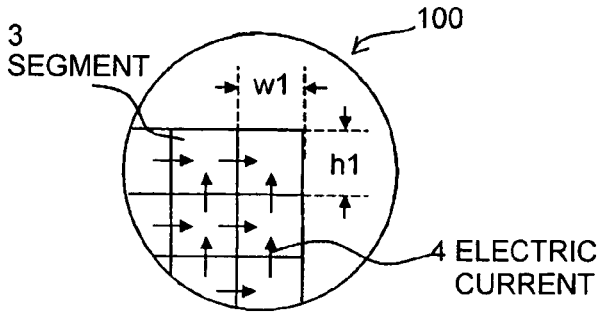
FIG. 3 is an enlarged view of a part 100 in FIG. 2.

FIGS. 2 and 3 are diagrams for explaining a method for designing a circular polarized wave antenna in the first preferred embodiment. FIG. 2 is a schematic diagram for explaining a method for designing a circular polarized wave antenna in the first preferred embodiment according to the present invention. FIG. 3 is an enlarged view of a part 100 in FIG. 2.

Firstly, as shown in FIGS. 2 and 3, an area constituting the antenna A1 is divided into segments 3 each having the dimensions of 3 mm×3 mm. As clearly shown in FIG. 3, electric current 4 flowing between adjacent segments 3 at least along two directions is assumed. Further, two axes x and y that are orthogonal to each other are determined.

Figure 4:
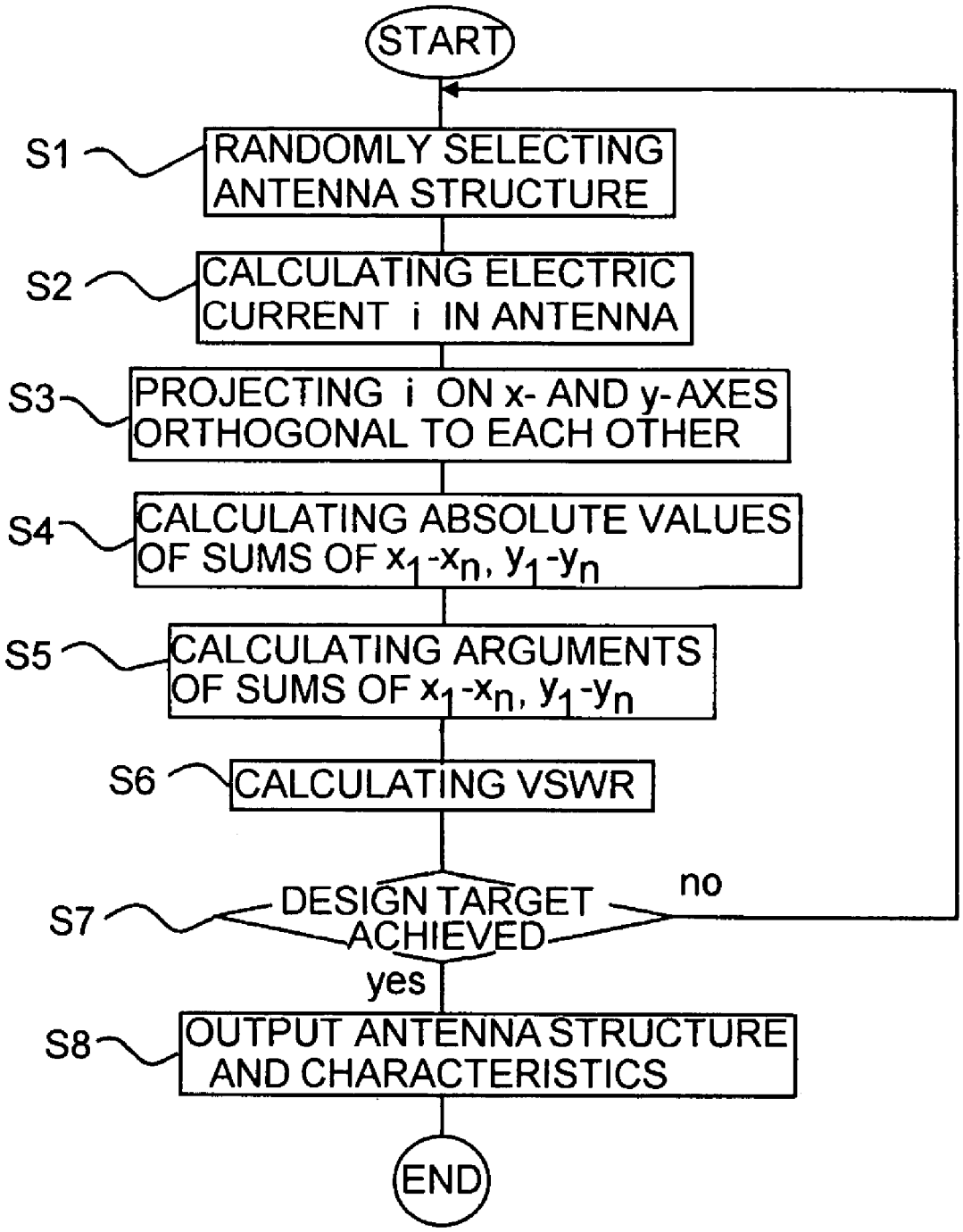
FIG. 4 is a flowchart showing a method for designing the circular polarized wave antenna in the first preferred embodiment according to the invention.

FIG. 4 is a flowchart showing a method for designing the circular polarized wave antenna in the first preferred embodiment according to the invention.

Next, the steps of designing the circular polarized wave antenna will be explained referring to FIG. 4.

Firstly, an antenna structure is randomly selected (S1) A group of the metallic conductors 1 is formed by removing 20% to 70% of the segments 3 each having the dimensions of 3 mm×3 mm of the metallic conductors is randomly removed from a total of the metallic conductors 1. A single power feed point 2 is randomly located at a position between any two adjacent segments 3 of the metallic conductor. Further, electric current i flown through the antenna is derived by using a Method of Moment (MoM) in which a current flowing along at least two directions is assumed (S2). Respective elements $i_1$ to $i_n$ of a vector i are projected with respect to at least two axes x and y that are orthogonal to each other (S3). Then, an absolute value of a sum of $x_1$ to $x_n$ and an absolute value of a sum of $y_1$ to $y_n$ in which projections of the respective elements $i_1$ to $i_n$ with respect to the x-axis are $x_1$ to $x_n$ and projections of the respective elements $i_1$ to $i_n$ with respect to the y-axis are $y_1$ to $y_n$ are calculated (S4). An argument of a sum of $x_1$ to $x_n$ and an argument of a sum of $y_1$ to $y_n$ are calculated (S5). A voltage standing wave ratio (VSWR) is calculated (S6). It is judged as to whether a design target is achieved (S7). If the design target is achieved, the antenna structure and the antenna characteristics thereof will be output (S8) at the end. If the design target is not achieved, the steps S1 to S7 will be repeated.

Herein, the design target is that the absolute value of the sum of $x_1$ to $x_n$ and the absolute value of the sum of $y_1$ to $y_n$ are approximately equal to each other, and that a difference between the argument of the sum of $x_1$ to $x_n$ and the argument of the sum of $y_1$ to $y_n$ is approximately 90°. Another design target, for example, that the voltage standing wave ratio is lower than a predetermined ratio may be added to the above design target. In the first preferred embodiment, the circular polarized wave antenna is such designed that the axial ratio (AR) showing the circular polarized wave characteristic is not more than 3 dB at a frequency of 1575 MHz and the voltage standing wave ratio (VSWR) is not more than 3 when an impedance of the power feed point is 50 Ω.

According to the method for designing a circular polarized wave antenna as shown in the flowchart of FIG. 4, it is possible to realize an automatic design using a computer. Therefore, it is possible to easily design the circular polarized wave antenna in accordance with the specification requirements in a short time. Further, according to the calculation and experiments, it is confirmed that the circular polarized wave antenna can be miniaturized by using this method, such that the sum of the electrical lengths a1 and b1 is approximately not more than ½ wavelength at the frequency to be used.

In more concrete, according to the calculation result using a computer, it is confirmed that the sum of the electrical lengths a+b is 0.4 times a wavelength at the frequency to be used, when the absolute value of the sum of $x_1$ to $x_n$ and the absolute value of the sum of $y_1$ to $y_n$ are equal to each other, and an absolute value of a difference between the argument of the sum of $x_1$ to $x_n$ and the argument of the sum of $y_1$ to $y_n$ is 90°.

Further, it is confirmed that the sum of the electrical lengths a+b is 0.65 times the wavelength at the frequency to be used, when a ratio of the absolute value of the sum of $x_1$ to $x_n$ with respect to the absolute value of the sum of $y_1$ to $y_n$ is 0.8 (or 1.25) and the absolute value of the difference between the argument of the sum of $x_1$ to $x_n$ and the argument of the sum of $y_1$ to $y_n$ is 70° (or 110°).

In brief, by designing the circular polarized wave antenna such that the absolute value of the sum of $x_1$ to $x_n$ and the absolute value of the sum of $y_1$ to $y_n$ are equal to each other (the ratio is 1) and the absolute value of the difference between the argument of the sum of $x_1$ to $x_n$ and the argument of the sum of $y_1$ to $y_n$ is 90°, it is possible to realize a smaller axial ratio (AR), thereby miniaturizing the dimensions of the circular polarized wave antenna.

Figure 5A:
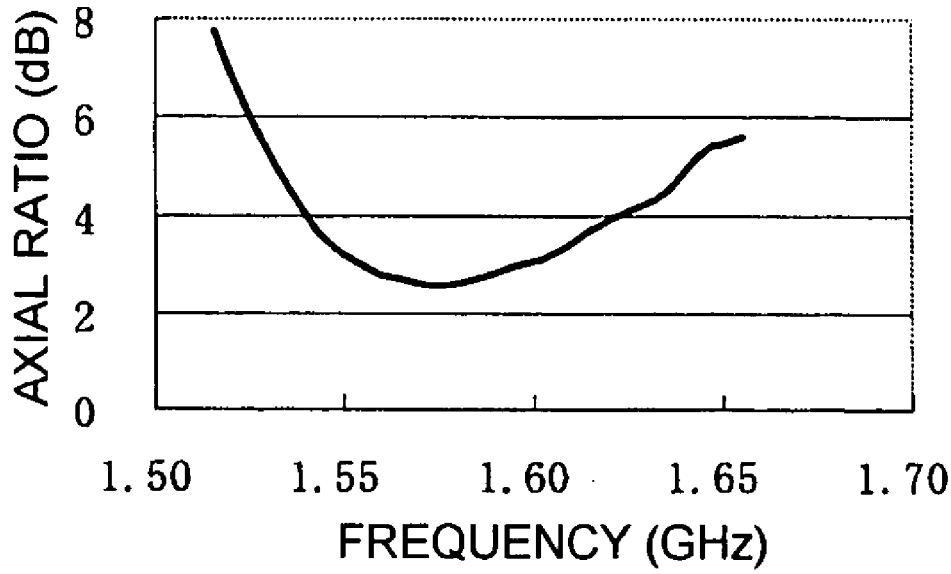
Figure 5B:
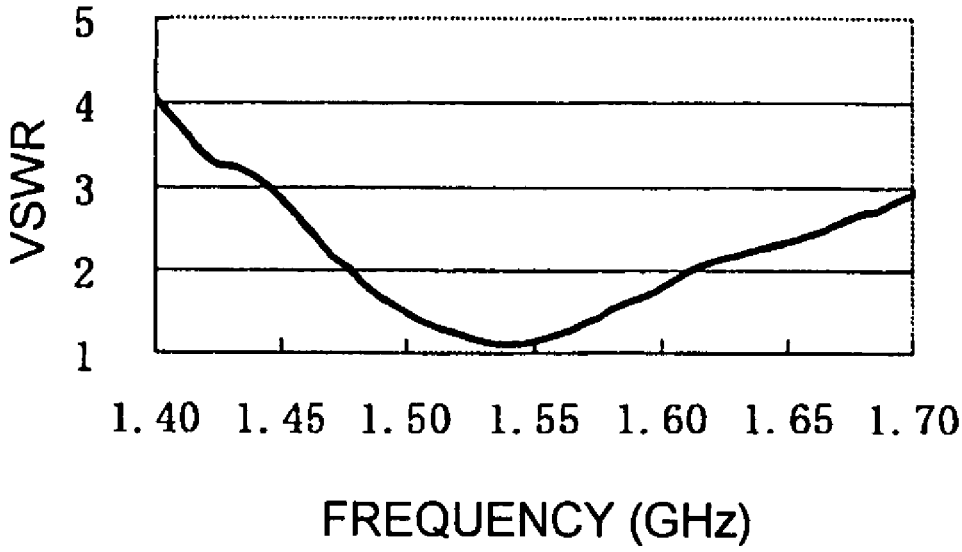

FIGS. 5A and 5B are graphs showing antenna characteristics of the circular polarized wave antenna in the first preferred embodiment according to the invention, wherein FIG. 5A is a graph showing a variation of an axial ratio (AR) at a frequency of 1.50 to 1.70 GHz, and FIG. 5B is a graph showing a variation of a voltage standing wave ratio (VSWR) at a frequency of 1.40 to 1.70 GHz.

As clearly shown in FIGS. 5A and 5B, the axial ratio (AR) is not more than 3 dB and the voltage standing wave ratio (VSWR) is not more than 3 at a frequency of 1575 MHz. Therefore, it is possible to transmit and receive the circular polarized wave with good antenna characteristics according to the circular polarized wave antenna in the first preferred embodiment.

Next, a circular polarized wave antenna in a second preferred embodiment will be explained referring to FIG. 6.

Figure 6:
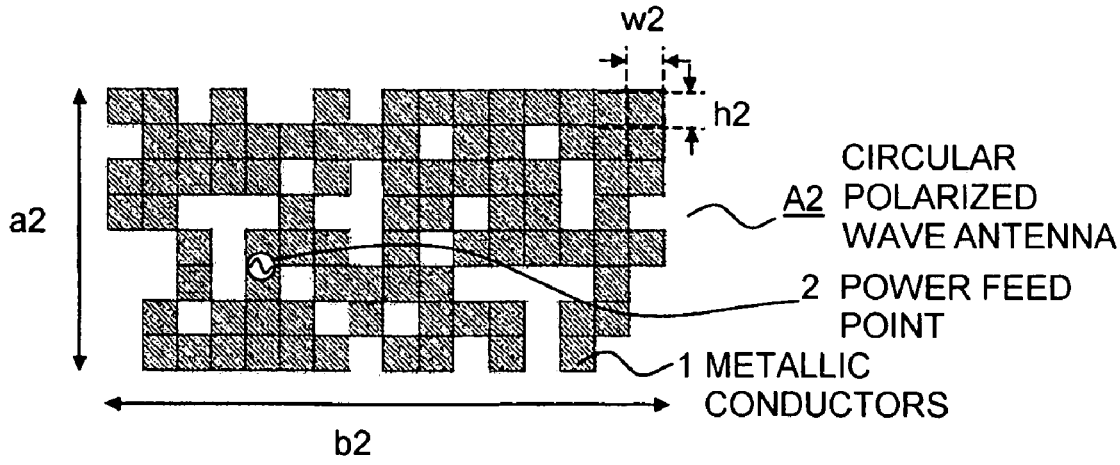
FIG. 6 is a schematic diagram showing a circular polarized wave antenna in a second preferred embodiment according to the invention.

FIG. 6 is a schematic diagram showing a circular polarized wave antenna A2 in the second preferred embodiment according to the invention.

A circular polarized wave antenna A2 comprises a group of metallic conductors 1 and a single power feed point 2, for transmitting and receiving a right-handed circular polarized wave at a frequency of 1575 MHz which is used for the GPS.

In the second preferred embodiment, a group of the metallic conductors 1 in the circular polarized antenna A2 has an outline of an oblong shape with an electrical length a2 of 32 mm and an electrical length b2, respectively. A sum of the electrical wavelengths a2 and b2 of both sides is approximately ½ wavelength at a frequency of 1575 MHz to be used. The group of the metallic conductors 1 is composed of an agglomeration of square metallic conductors each having dimensions of for example 4 mm×4 mm (a height h2 of 4 mm and a width w2 of 4 mm).

The circular polarized wave antenna A2 in the second preferred embodiment is designed, such that an axial ratio (AR) at a frequency of 1575 MHz is not more than 3 according to the method for designing a circular polarized wave antenna as shown in the flowchart of FIG. 4.

The circular polarized wave antenna in the second preferred embodiment is small and thin, and suitable for mounting on a mobile transmitting and receiving apparatus. Further, since the outline shape of the circular polarized wave antenna A2 is not square-like but oblong, a possibility of design for mounting in the mobile transmitting and receiving apparatus is increased.

Figure 7:
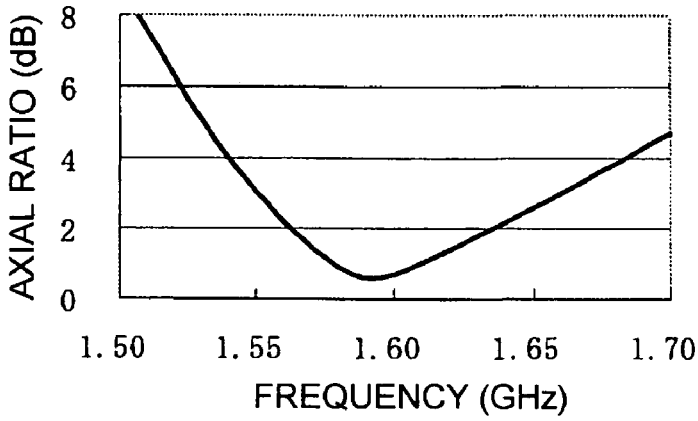
FIG. 7 is a graph showing a variation of an axial ratio (AR) at a frequency of 1.50 to 1.70 GHz in the second preferred embodiment according to the invention.

FIG. 7 is a graph showing a variation of an axial ratio (AR) at a frequency of 1.50 to 1.70 GHz in the second preferred embodiment according to the invention. Therefore, it is possible to transmit and receive the circular polarized wave with good antenna characteristics according to the circular polarized wave antenna in the second preferred embodiment.

Next, a circular polarized wave antenna in a third preferred embodiment will be explained referring to FIG. 8.

Figure 8:
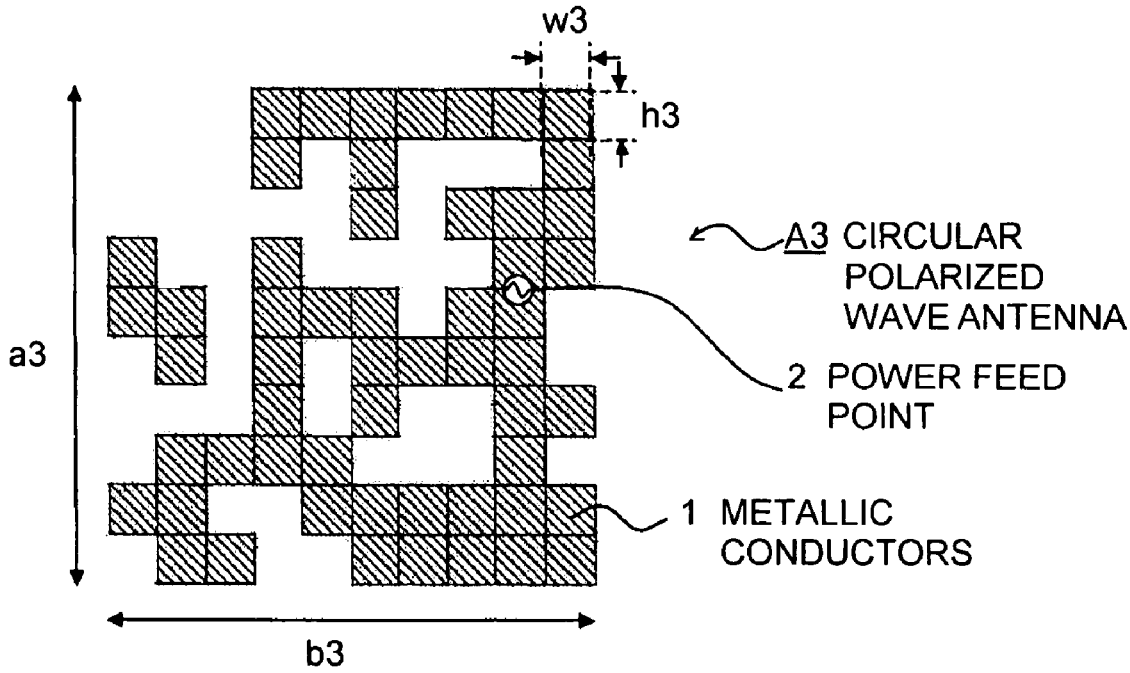
FIG. 8 is a schematic diagram showing a circular polarized wave antenna in a third preferred embodiment according to the invention.

FIG. 8 is a schematic diagram showing a circular polarized wave antenna A3 in the third preferred embodiment according to the invention.

A circular polarized wave antenna A3 comprises a group of metallic conductors 1 and a single power feed point 2, for transmitting and receiving a right-handed circular polarized wave at a frequency of 1575 MHz which is used for the GPS and a left-handed circular polarized wave at a frequency of 2300 MHz which is used for a satellite radio broadcasting.

In the third preferred embodiment, a group of the metallic conductors 1 in the circular polarized antenna A3 has an outline of a rectangular shape, for example, with an electrical length a3 of 100 mm and an electrical length b3 of 100 mm, respectively. The group of the metallic conductors 1 is composed of an agglomeration of square metallic conductors each having dimensions of for example 10 mm×10 mm (a height h3 of 10 mm and a width w3 of 10 mm).

Figure 9:
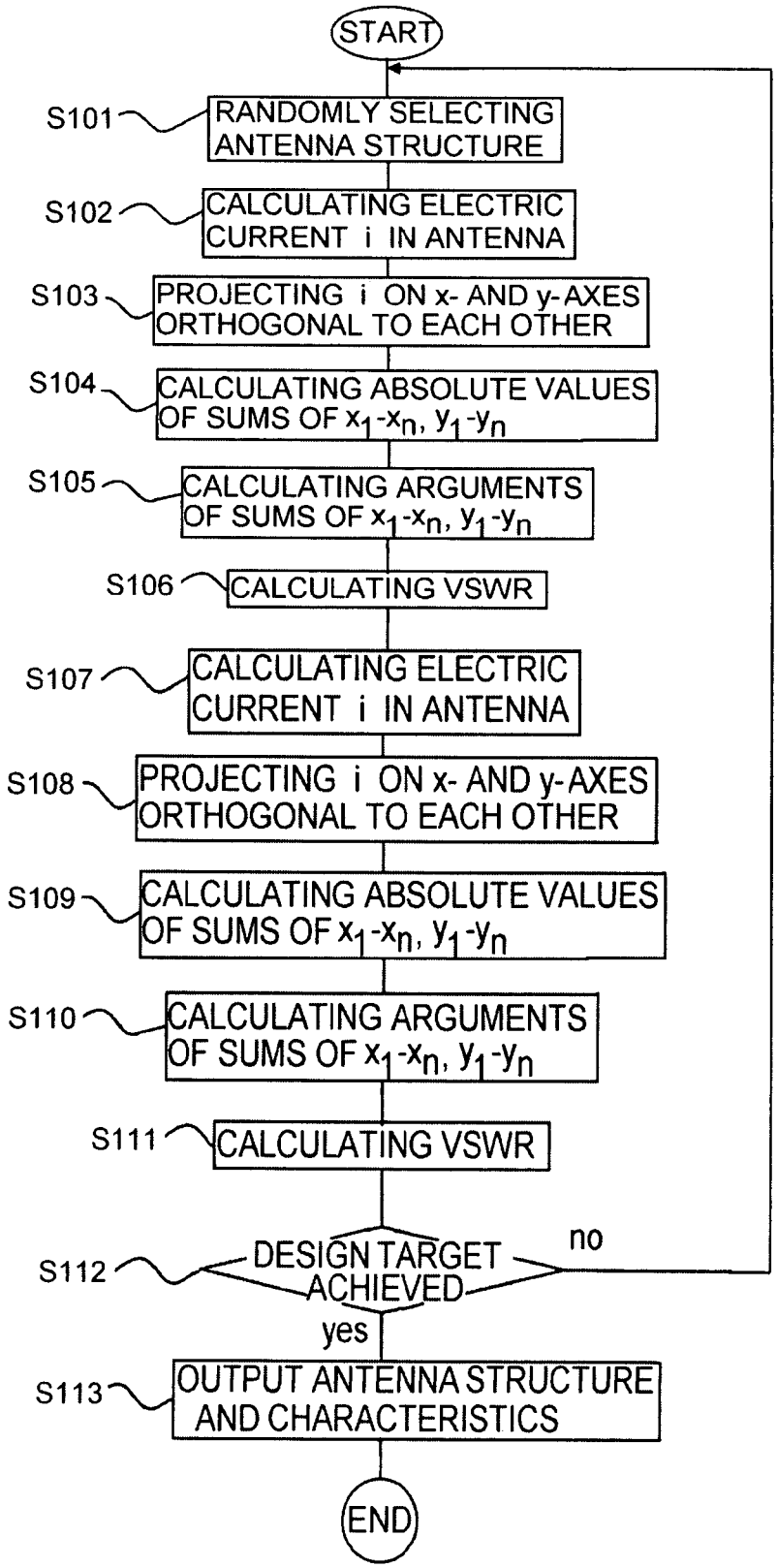
FIG. 9 is a flowchart showing a method for designing the circular polarized wave antenna in the third preferred embodiment according to the invention.

FIG. 9 is a flowchart showing a method for designing the circular polarized wave antenna in the third preferred embodiment according to the invention.

The steps for designing a circular polarized wave antenna similar to those shown in the flowchart of FIG. 4 are conducted for a first frequency and a second frequency.

Firstly, an antenna structure is randomly selected (S101).

In steps S102 to S106, the antenna characteristics for the first frequency are calculated.

A group of the metallic conductors 1 is formed by removing 20% to 70% of the segments 3 each having the dimensions of 10 mm×10 mm of the metallic conductors is randomly removed from a total of the metallic conductors 1. A single power feed point 2 is randomly located at a position between any two adjacent segments 3 of the metallic conductor. Then, electric current i flown through the antenna for the first frequency (e.g. 1575 MHz) is derived by using a Method of Moment (MoM) in which a current flowing along at least two directions is assumed (S102). Respective elements $i_1$ to $i_n$ of a vector i are projected with respect to at least two axes x and y that are orthogonal to each other (S103). Then, an absolute value of a sum of $x_1$ to $x_n$ and an absolute value of a sum of $y_1$ to $y_n$ in which projections of the respective elements $i_1$ to $i_n$ with respect to the x-axis are $x_1$ to $x_n$ and projections of the respective elements $i_1$ to $i_n$ with respect to the y-axis are $y_1$ to $y_n$ are calculated (S104). An argument of a sum of $x_1$ to $x_n$ and an argument of a sum of $y_1$ to $y_n$ are calculated (S105). A voltage standing wave ratio (VSWR) for the first frequency is calculated (S106).

In steps S107 to S111, the antenna characteristics for the second frequency are calculated.

Again, electric current i flown through the antenna for the second frequency is derived by using a Method of Moment (MoM) in which a current flowing along at least two directions is assumed (S107). Respective elements $i_1$ to $i_n$ of a vector i are projected with respect to at least two axes x and y that are orthogonal to each other (S108). Then, an absolute value of a sum of $x_1$ to $x_n$ and an absolute value of a sum of $y_1$ to $y_n$ in which projections of the respective elements $i_1$ to $i_n$ with respect to the x-axis are $x_1$ to $x_n$ and projections of the respective elements $i_1$ to $i_n$ with respect to the y-axis are $y_1$ to $y_n$ are calculated (S109). An argument of a sum of $x_1$ to $x_n$ and an argument of a sum of $y_1$ to $y_n$ are calculated (S110). A voltage standing wave ratio (VSWR) for the second frequency is calculated (S111).

Then, it is judged as to whether a design target is achieved for the first and second frequencies (S112). If the design target is achieved, the antenna structure and the antenna characteristics thereof will be output (S113), and the flow is finished. If the design target is not achieved, the steps S101 to S112 will be repeated.

In the third preferred embodiment, the steps S102 to S106 are conducted to design a circular polarized wave antenna for transmitting and receiving a right-handed circular polarized wave at the first frequency of 1575 MHz such that the axial ratio (AR) is not more than 3 dB and the voltage standing wave ratio (VSWR) is not more than 4 when an impedance of the power feed point is 50 Ω. The steps S107 to S111 are conducted to design a circular polarized wave antenna for transmitting and receiving a left-handed circular polarized wave at the first frequency of 2300 MHz such that the axial ratio (AR) is not more than 3 dB and the voltage standing wave ratio (VSWR) is not more than 4 when an impedance of the power feed point is 50 Ω.

Figure 10A:
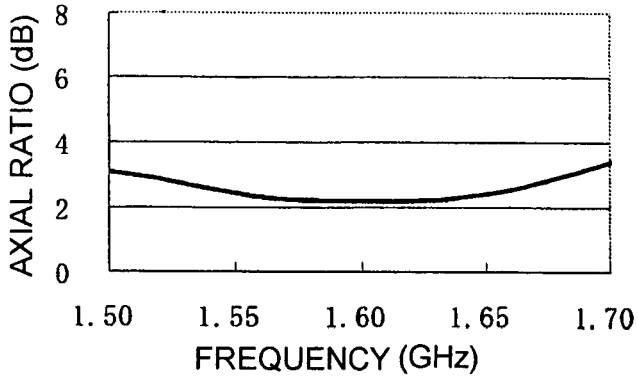
Figure 10B:
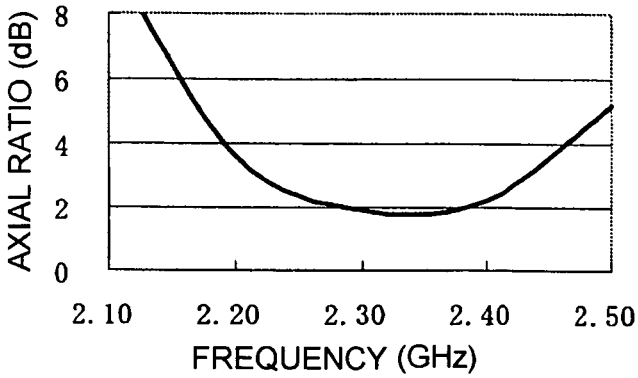
Figure 10C:
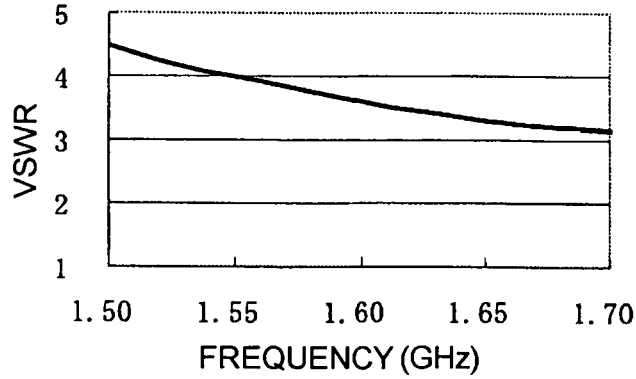
Figure 10D:
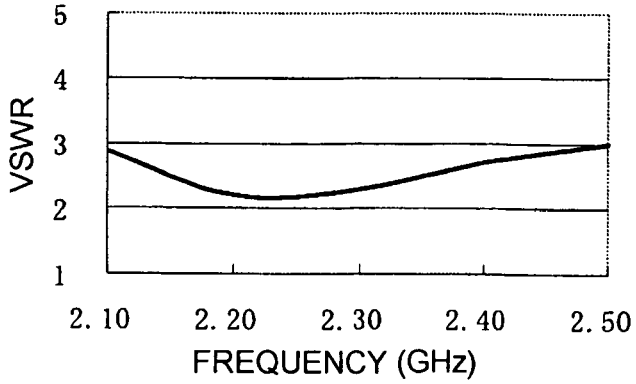

FIGS. 10A to 10D are graphs showing antenna characteristics of the circular polarized wave antenna in the third preferred embodiment according to the invention, wherein FIG. 10A is a graph showing a variation of an axial ratio (AR) at a frequency of 1.50 to 1.70 GHz, FIG. 10B is a graph showing a variation of an axial ratio (AR) at a frequency of 2.10 to 2.50 GHz, FIG. 10C is a graph showing a variation of a voltage standing wave ratio (VSWR) at a frequency of 1.50 to 1.70 GHz, and FIG. 10D is a graph showing a variation of a voltage standing wave ratio(VSWR) at a frequency of 2.10 to 2.50 GHz.

As clearly shown in FIGS. 10A to 10D, it is possible to transmit and receive the circular polarized wave with the axial ratio (AR) of not more than 3 dB and the voltage standing wave ratio (VSWR) of not more than 4 for both the frequency of 1575 MHz and the frequency of 2300 MHz according to the circular polarized wave antenna in the third preferred embodiment.

According to the circular polarized wave antenna in the third preferred embodiment, it is possible to transmit and receive the circular polarized waves with two different frequencies by using a single antenna. Therefore, it is suitable for realizing the mobile transmitting and receiving apparatus with higher functions, and it is effective for simplifying an antenna periphery part thereof.

Next, a circular polarized wave antenna in a fourth preferred embodiment will be explained referring to FIG. 11.

Figure 11:
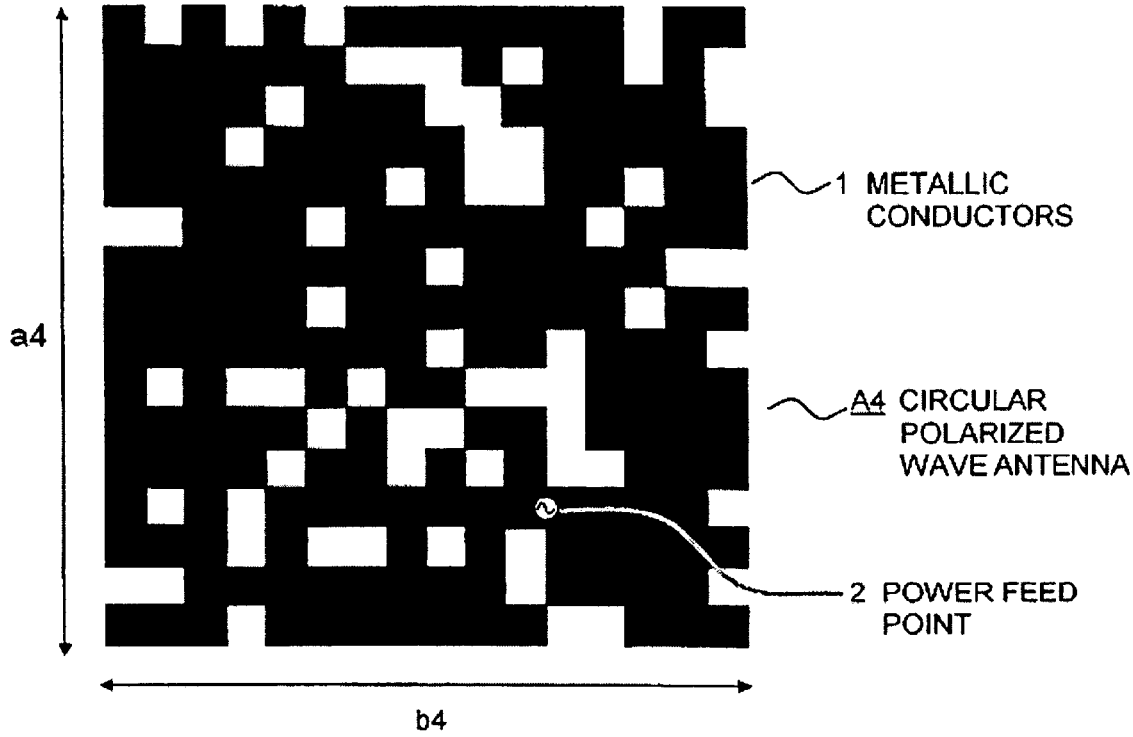
FIG. 11 is a schematic diagram showing a circular polarized wave antenna in a fourth preferred embodiment according to the invention.

FIG. 11 is a schematic diagram showing a circular polarized wave antenna A4 in the fourth preferred embodiment according to the invention.

A circular polarized wave antenna A4 comprises a group of metallic conductors 1 and a single power feed point 2, for transmitting and receiving a circular polarized wave a predetermined frequency between adjacent frequencies, for example, a first frequency of 3.5 GHz and a second frequency of 4.5 GHz. Herein, the "adjacent frequencies" here are determined as two frequencies f1 and f2 satisfying following conditions:

$$f3=(f1+f2)/2, \text{ and}$$

$$f2-f1 \leqq 0.25 \times f3,$$

wherein f1 is a first frequency, f2 is a second frequency, and f3 is a center frequency.

The circular polarized wave antenna in the fourth preferred embodiment is designed by using the method for designing a circular polarized wave antenna as shown in the flowchart of FIG. 9, for transmitting and receiving a right-handed circular polarized wave at the frequency of 3.5 GHz and the frequency of 4.5 GHz such that the axial ratio (AR) is not more than 3 dB and the voltage standing wave ratio (VSWR) is not more than 3 when an impedance of the power feed point is 50 Ω.

In the fourth preferred embodiment, a group of the metallic conductors 1 in the circular polarized antenna A4 has an outline of a rectangular (square-like) shape, for example, with an electrical length a4 of 38 mm and an electrical length b4 of 38 mm, respectively.

Figure 12A:
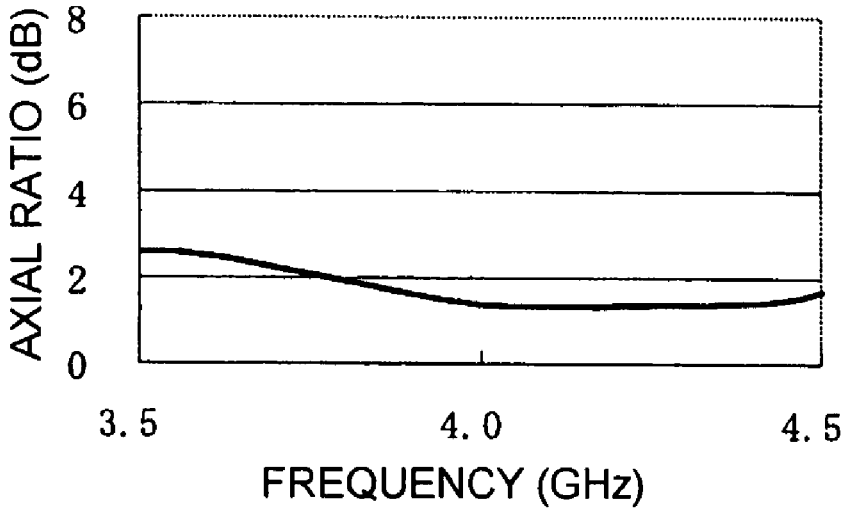
Figure 12B:
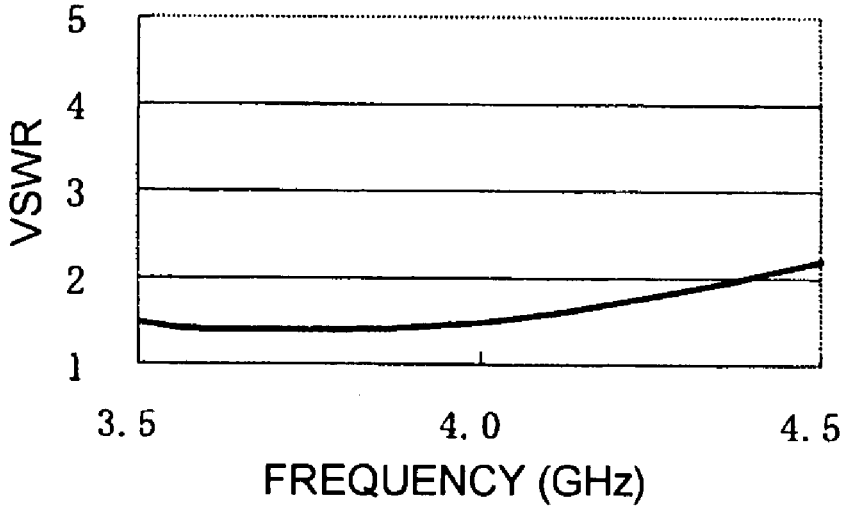

FIGS. 12A and 12B are graphs showing antenna characteristics of the circular polarized wave antenna A4 in the fourth preferred embodiment according to the invention, wherein FIG. 12A is a graph showing a variation of an axial ratio (AR) at a frequency of 3.5 to 4.5 GHz, and FIG. 12B is a graph showing a variation of a voltage standing wave ratio (VSWR) at a frequency of 3.5 to 4.5 GHz.

As clearly shown in FIGS. 12A and 12B, it is possible to transmit and receive the circular polarized wave with the axial ratio (AR) of not more than 3 dB and the voltage standing wave ratio (VSWR) of not more than 3 at a frequency between 3.5 GHz and 4.5 GHz according to the circular polarized wave antenna in the fourth preferred embodiment. Namely, it is possible to transmit a circular polarized wave with good characteristics at a broad frequency band.

The circular polarized wave antenna in the fourth preferred embodiment is suitable for realizing the transmitting and receiving apparatus with the high functions, since it is possible to transmit and receive the circular polarized wave in a broad frequency band by using a single antenna.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A circular polarized wave antenna, comprising:

a group of metallic conductors; and a power feed point formed at one of the metallic conductors;

wherein an absolute value of a sum of projections of an electric current induced on the metallic conductors in a first axis and an absolute value of a sum of projection of the electric current in a second axis that is spatially orthogonal to the first axis are approximately equal to each other, and an absolute value of a difference between arguments of the sums of the projections in the first and second axes is approximately 90°.

2. The circular polarized wave antenna, according to claim 1, wherein:

an outline of the group of the metallic conductors is a rectangular shape, and comprises a first side with a first electrical length and a second side with a second electrical length.

3. The circular polarized wave antenna, according to claim 2, wherein:

the circular polarized wave antenna is adapted to transmit and receive a circuit polarized wave having a single frequency, and a sum of the first electrical length and the second electrical length is from 0.4 times to 0.65 times more than a wavelength at the frequency to be used.

4. The circular polarized wave antenna, according to claim 2, wherein:

the circular polarized wave antenna is adapted to transmit and receive circular polarized waves having different frequencies, and a sum of the first electrical length and the second electrical length is from 0.8 times to 1.6 times more than a wavelength at each of the frequencies to be used.

5. The circular polarized wave antenna, according to claim 4, wherein:

a first frequency and a second frequency in the different frequencies are adjacent to each other and the circular polarized wave is transmitted and received at all frequencies between the first and second frequencies.

6. The circular polarized wave antenna, according to claim 5, wherein:

the first and second frequencies satisfy following condition:

$$f3=(f1+f2)/2, \text{ and}$$

$$f2-f1 \leqq 0.25 \times f3,$$

wherein f1 is the first frequency, f2 is the second frequency, and f3 is a center frequency between the first and second frequencies.

7. The circular polarized wave antenna, according to claim 5, wherein:

a right-handed circular polarized wave is transmitted and received at the first frequency, and a left-handed circular polarized wave is transmitted and received at the second frequency.

8. The circular polarized wave antenna, according to claim 1:

the group of the metallic conductors comprises a group of square segments.

9. A method for designing a circular polarized wave antenna, comprising:

a first step of providing a group of metallic conductors comprising a group of square segments;

a second step of changing a structure of the metallic conductors;

a third step of calculating an electric current induced in the group of the square segments;

a fourth step of calculating an absolute value of a sum of projections of the electric current in a first axis and an absolute value of a sum of projection of the electric current in a second axis that is spatially orthogonal to the first axis, and an absolute value of a difference between arguments of the sums of the projections in the first and second axes; and a fifth step of changing the structure of the metallic conductors, until the absolute value of the sum of the projections of the electric current in the first axis and the absolute value of the sum of projection of the electric current in the second axis is approximately equal to each other and the absolute value of the difference in the arguments is approximately 90°.

10. The method for designing a circular polarized wave antenna, according to claim 9, wherein:

the first to fifth steps are conducted for different frequencies respectively.

* * * * *